US008172154B1

(12) United States Patent
Figley et al.

(10) Patent No.: US 8,172,154 B1
(45) Date of Patent: May 8, 2012

(54) HUMIDITY MONITORING AND ALARM SYSTEM FOR UNATTENDED DETECTION OF BUILDING MOISTURE MANAGEMENT PROBLEMS

(76) Inventors: Donald A. Figley, Saskatoon (CA); Chase R. Figley, Saskatoon (CA); Sarah A. Figley, Saskatoon (CA); Curtis M. Figley, Edmonton (CA)

( * ) Notice: Subject to any disclaimer, the term of this patent is extended or adjusted under 35 U.S.C. 154(b) by 725 days.

(21) Appl. No.: 11/892,587

(22) Filed: Aug. 24, 2007

Related U.S. Application Data

(60) Provisional application No. 60/891,113, filed on Feb. 22, 2007.

(51) Int. Cl.
*F24F 3/14* (2006.01)
*G05D 23/00* (2006.01)
*F25B 49/00* (2006.01)

(52) U.S. Cl. ..... 236/44 A; 236/94; 62/176.1; 165/223; 165/224

(58) Field of Classification Search ..... 62/176.1, 62/176.6; 165/222, 223, 224; 236/44 A, 236/44 C, 46 C, 94
See application file for complete search history.

(56) References Cited

U.S. PATENT DOCUMENTS

| | | | | |
|---|---|---|---|---|
| 4,953,784 | A * | 9/1990 | Yasufuku et al. | 236/44 A |
| 5,257,735 | A * | 11/1993 | Takahashi et al. | 236/44 A |
| 6,145,750 | A * | 11/2000 | Carpenter | 236/44 A |
| 6,230,980 | B1 * | 5/2001 | Hudson | 236/44 A |
| 6,826,920 | B2 * | 12/2004 | Wacker | 62/176.6 |
| 6,935,570 | B2 * | 8/2005 | Acker, Jr. | 236/44 R |
| 6,966,364 | B1 * | 11/2005 | Babikian et al. | 165/228 |
| 6,978,631 | B2 * | 12/2005 | Fuller | 62/176.6 |
| 7,325,748 | B2 * | 2/2008 | Acker, Jr. | 236/44 A |
| 7,340,907 | B2 * | 3/2008 | Vogh, III | 62/150 |
| 7,360,717 | B2 * | 4/2008 | Shah | 236/46 R |
| 7,712,319 | B2 * | 5/2010 | Braun et al. | 62/126 |
| 2004/0041036 | A1 * | 3/2004 | Acker, Jr. | 236/44 A |
| 2004/0262410 | A1 * | 12/2004 | Hull | 236/91 R |
| 2005/0087612 | A1 * | 4/2005 | Fuller | 236/44 A |
| 2005/0194456 | A1 * | 9/2005 | Tessier et al. | 236/51 |
| 2005/0252983 | A1 * | 11/2005 | Acker, Jr. | 236/44 R |
| 2005/0269418 | A1 * | 12/2005 | Fuller | 236/44 A |
| 2007/0107450 | A1 * | 5/2007 | Sasao et al. | 62/185 |

* cited by examiner

*Primary Examiner* — Chen Wen Jiang
(74) *Attorney, Agent, or Firm* — The Marbury Law Group, PLLC

(57) ABSTRACT

A detection and monitoring method and system which makes it possible to detect the presence of moisture problems when they manifest as abnormal humidity in one or more discrete ventilation zones within a building envelope. The abnormal humidity can then be investigated and resolved or mitigated to minimize the potential for building damage or adverse occupant health effects occur. The present invention provides an early warning system that will alert personnel of the occurrence of a moisture problem.

7 Claims, 4 Drawing Sheets

HUMIDITY MONITORING AND ALARM SYSTEM FOR UNATTENDED DETECTION OF BUILDING MOISTURE MANAGEMENT PROBLEMS

CROSS-REFERENCE TO RELATED APPLICATIONS

The present application claims the priority date of Feb. 22, 2007, which is the filing date of Provisional Application Ser. No. 60/891,113 filed by the present inventive entity.

TECHNICAL FIELD OF THE INVENTION

This invention relates to the general field of building and structure sciences and the particular fields related to the underlying technologies of building structures and mechanical systems used to design, construct and maintain buildings and building environmental systems, including Heating, Ventilation and Air Conditioning (HVAC) practices. The intention of such technologies and practices is to design and/or retrofit buildings so that they can be kept in a good state and to enhance building performance such that occupant comfort and health are maintained at an acceptable level and the building has an acceptable service life.

BACKGROUND OF THE INVENTION

Research into the effects of uncontrolled moisture, including moisture in the form of high humidity levels has clearly demonstrated that exposure to high humidity levels leads to a variety of building related problems. Relevant background material on moisture effects and control is included in the references identified in and incorporated by reference into this disclosure. The extent of the resulting damage will be related to many factors, however as a general principle, increasing amounts of moisture distributed in expanding areas for increasing amounts of time will all (individually and in combination) result in a corresponding increase in the negative impacts on the building. There is a very clear relationship between moisture management problems and mold contamination problems in buildings.

The range of negative impacts is large, however some examples include:

1. Cosmetic and structural damage caused by staining, corrosion, dimensional changes due to moisture content changes in materials and microbial growth such as fungi, including mold and wood decaying fungi.

2. Damage to other building systems such as corrosion of electrical components and mold growth on duct and pipe insulation.

3. Increased building operating costs due to excessive moisture removal loads on cooling or dehumidification equipment, make-up air systems or other building services.

4. Loss of use of buildings or areas of buildings. In the case of homes, schools, health care facilities and other buildings, the loss of use may have significant impacts on many aspects of the occupants and the ability to provide for basic needs.

5. Increased custodial and maintenance requirements to maintain and remediate the effects of moisture problems.

6. Reduction in the value of the building as an asset due to the inherent liabilities associated with moisture and/or mold problems.

7. A diverse range of adverse health affects have been attributed to the exposure of occupants to damp and/or moldy buildings.

These basic concepts and concerns form the focal point of many documents related to investigating moisture management problems in buildings, preventing moisture damage and remediating moisture damage.

Various organizations, including Canadian and United States Federal Government Agencies, have recognized moisture management and mold contamination problems as being significant issues for buildings and building occupants. Regular inspections and prompt responses to problems are a key component of good building management. References related to the general issues of building science, indoor air quality, moisture management and mold related building issues include (the disclosures of which are incorporated herein by reference):

(1) "Mold Remediation in Schools and Commercial Buildings", US EPA, Washington, D.C., March 2001.

(2) "Health Canada proposes a new guideline on mould in residential indoor air", Environmental and Workplace Health, Health Canada, Ottawa, ON., Jan. 26, 2007.

(3) "Fungal Contamination in Public Buildings: Health Effects and Investigation Methods", Health Canada, Ottawa, ON., 2004.

(4) "Clean-Up Procedures for Mold in Houses", Canada Mortgage and Housing Corporation, Ottawa, ON., Revised 2005.

In the specific area of moisture problems in building crawl space foundations, the following reference paper contains material that can serve as background and supporting information, and this paper is incorporated herein by reference:

Figley, D. A., Sieber, R. "Cleanup of Microbial Contamination in Major Building Crawlspaces", Proceedings of the 9th International Conference on Indoor Air Quality and Climate, Indoor 2002, Monterey, Calif., Jun. 30-Jul. 5, 2002.

This paper summarizes the experiences obtained from the investigation and remediation of a number of building crawl spaces and identifies the significant problems caused by the lack of moisture control and early detection of major moisture release events. The material and concepts described in this paper form part of this disclosure and are included by reference.

Moisture management is the general art and process of understanding and controlling moisture activity in a building structure. Moisture can be present in many forms including, but not limited to:

(1) vapor or humidity in the air;

(2) water evaporated, absorbed or precipitated through dew or condensation, typically onto surfaces or into structural or building assemblies and volumes including moisture present on or within building components including structural members;

water present as snow, ice, or frost buildup which can melt to produce an uncontrolled source of liquid water; or (3) water present as an exposed liquid, typically as puddles or that might lie on surfaces as it migrates to a lower level, such as wetted walls, foundations or window surfaces.

Mechanisms that may bring water within a building (or alternately, collect small amounts of water until they form a large source of moisture) are many, including but not limited to:

(1) humidity present in the ventilation air source, typically outdoor air that is drawn into the building and conditioned either intentionally as part of the HVAC makeup air or combustion air or unintentionally as a result of leaks within the building envelope air/vapour barrier assembly;

(2) water introduced by introducing wet articles into the conditioned building envelope such as wet clothing, snow and rain on articles of equipment, vehicles and the like, drying of wet materials such as firewood, etc.;

(3) humidity introduced by occupant activities such as cleaning, washing, clothes drying, cooking, plant watering and bathing;

(4) moisture introduced through unintentional water releases such as plumbing and heating system leaks, sewer backup, vandalism and the like;

(5) moisture introduced through structural or moisture barrier leaks including but not limited to roof and foundation leaks, absent or impaired access hatches or windows or the like that can allow, rain, snow melt, surface or ground water to enter the conditioned spaces of a building; or frost or ice buildup on cold surfaces exposed to moist air which at some point may thaw and produce unanticipated water sources.

Note, that within this disclosure, "conditioned" refers to air, air volumes and building zones intended to be brought into and maintained within a define or acceptable range of temperatures through the use of HVAC techniques known to the art.

Current best practices for moisture control can include a combination of:

(1) proper building and building envelope design, including material selection and construction methods;

(2) foundation drainage systems including collection and disposal piping systems;

effective environmental water drainage including building location selection, grading the building surroundings for proper surface runoff of storm water drainage and snow melt, effective snow removal practices and the like;

(3) well conditioned air to ventilate the affected building volumes;

training for occupants and building operators to make them aware of their impact on moisture management and to provide them with practices and policies to reduce moisture problems in buildings;

(4) routine inspection and maintenance of all building areas and systems to allow for detection and repair of moisture management problems; and (5) detection of water leakage and/or water collection in both occupied and unoccupied areas using sump alarms, floor wetting detectors, water conductivity alarms and the like.

However, in real world practice, it is not always possible to incorporate or design for all possible scenarios or extremes, nor for the occurrence of the myriad possible building system impairments or breakdowns. As well, traditional sump pump alarms and floor wetting detectors can not always detect a leak or water entry point, since for these to function properly, significant amounts of water need to be present at the detection site. Excessive moisture can occur without these systems being activated. Confounding this situation is the effect of occupant lifestyle and in many cases, the lack of continued effective, routine inspections and maintenance.

It should also be noted that many locations in a typical building structure are not easily inspected on a day-to-day basis, so these locations tend to be investigated only when problems show up elsewhere in a building or there are other reasons to suspect a problem condition might be present.

For instance, conditioned crawlspaces under large buildings are difficult to inspect fully, as access is restricted, lighting is typically poor and there are often regions that have poor sight lines from where an inspector can position themselves. Additionally, these crawlspaces are often subdivided into relatively small areas as part of the fire protection and containment design of a building. The crawlspaces are often also where many of the buildings service lines run, such as water and sewer lines which can leak and are also where water from leaks and spills on higher floors migrates.

As a net result, these types of spaces can often have significant moisture problems for extended periods before being discovered. These types of situations are common in unsupervised areas in many buildings structures such as nursing residences, schools, homes residences, public buildings, offices and other such structures. These problems can also be present in occupied portions of buildings if the occupants are not observant or are not trained to recognize conditions indicative of moisture control failures.

Of further concern are buildings or building areas that may not normally be occupied, may not be frequently inspected or may otherwise be out of sight or out of mind for extended periods. These scenarios occur often, for instance with:

(1) buildings not occupied for periods of a day or more, such as churches, meeting halls, homes with vacationing occupants or for sale, business offices that are empty over the weekend and the like;

(2) schools closed for the season or for holidays;

(3) buildings with seasonal occupancy such as cabins, camps and the like; and (4) buildings not intended to be regularly occupied such as pump houses, utility buildings, storage sheds and warehouses, parking garages and the like.

As a result, many buildings suffer serious damage from moisture control problems that could otherwise be avoided given an appropriate measurement and warning system capable of detecting the moisture problems early.

OBJECTS OF THE INVENTION

It is an object of this invention to monitor the humidity levels in a building or structure and warn of high or unusual humidity conditions that might result in accelerated building deterioration including structural damage, fungal or mold colonization, flood and the resulting health and property issues that result from such occurrences.

It is a further object of this invention to provide alarms to warn the building operator of problematic moisture conditions in any or all of occupied, unoccupied or unsupervised zones within a building envelope.

It is yet another object of this invention to provide the operator utilizing a systems as taught by this invention with an estimate of the magnitude of the moisture problem.

It is yet a further object of this invention to determine the expected levels of moisture in building zones, based upon the characteristics and source of ventilation air and react to unexplained levels of moisture or rates of increase in the moisture content determined at various locations within the building.

It is an object of this invention to expedite the detection and localization of moisture sources such as seepage, water leaks or floods from building systems or that might enter a building from the exterior.

It is another object of this invention to detect both localized and distributed moisture problems resulting from improper ventilation, leakage, seepage, condensation, frost melt, precipitation, flood and the like within an area, volume or zone, without the requirement for direct contact with the water or the wetted surface.

It is a further object of this invention to detect occupancy behavior that may lead to excessively high humidity levels within conditioned air spaces within a building envelope.

It is a further object of this invention to monitor ambient humidity trends so that mitigations and remediations to alleviate high moisture situations can be sought before significant damage to the building (including mold contamination) can occur and before occupant health is negatively impacted.

It is another object of the invention to reduce the cost and severity of building repairs or remediations through the early detection of problematic humidity conditions.

It is yet another object of the invention to suppress false alarms caused by predictable or assessable changes in the moisture content of the air that are due to known causes that are not considered moisture control problems.

It is a further object of the invention to compare moisture levels in monitored areas to the ambient levels, to discriminate between changes due to normal building use patterns and external environmental conditions and changes due to moisture introduced by building system failures such as leaks.

SUMMARY OF THE INVENTION

This invention provides suitable detection and monitoring capability in an automated system thus making it possible to detect the presence of moisture problems when they manifest as abnormal humidity in one or more discrete ventilation zones within a building envelope. The abnormal humidity can then be investigated and resolved or mitigated well before building damage or adverse occupant health effects occur. The present invention provides an early warning system that will alert personnel prior to the occurrence of a moisture problem.

In general, the invention is embodied in a method wherein the moisture contents within various air volumes around and within a building environmental envelope are monitored and alarms are generated when site configurable combinations of moisture conditions and moisture trends are inconsistent with proper building operation and performance.

As used herein, the term "proper building operation and performance" means enabling the building to perform consistent with it's intended use and for it's intended lifetime, by assisting in maintaining the building in a state wherein the moisture conditions are conducive to occupant health and comfort as determined by appropriate Health and Building Code requirements or other accepted engineering and operating standards, such as ASHRE, while the integrity of the building structure and contents are enhanced or preserved. While ASHRE has been specifically mentioned, it is understood that those skilled in the art will know of other suitable sources of such information.

Furthermore, as used herein, the term "site configurable combinations of moisture conditions" means that a particular installation of a system can be configured and commissioned by a knowledgeable operator who determines what particular combination of preset alarm threshold values and integration time constants are appropriate for the particular installation, based upon engineering principles and site specific knowledge of the particular building and that building's operational requirements as determined by appropriate Health and Building Code requirements or other accepted engineering and operating standards, such as ASHRE, or other recognized sources of such information as will be understood by those skilled in the art More specifically, the invention is embodied in a method of monitoring the moisture content of air located in a structure comprising: measuring the moisture content in a sample of air at a reference location and using the moisture content in the sample of air from the reference location as a normal value; measuring the moisture content in air located at a selected location within a structure and using the moisture content in the air from the selected location as a sensed value; smoothing the temporal characteristics of the measured values over one or more time frames to reduce the effects of measurement noise and short term moisture transients; relating the smoothed sensed value of moisture content from the selected location to the smoothed normal moisture content from the reference location and defining a differential moisture content; and generating an alarm if the differential moisture content exceeds a preset value. As used herein, the term "preset value" is defined as a value that has been independently determined to be appropriate for the particular building and occupancy situation by knowledgeable practitioners based on experience in similar applications and situations and through the use of engineering principals. Essentially, this is value is based on the body of knowledge available to the person who configures the system.

For instance, water leaks that are relatively small can evaporate in conditioned air spaces before the water manages to collect at a floor wetting detector or sump. However, these leaks can still be large enough to significantly impact the humidity in the zone, with all the attendant problems that creates. With a detection mechanism based on humidity, small volume rate leaks can be detected earlier.

A particular improvement of this invention over prior art is that it takes advantage of the volume mixing and integration capability provided by the ventilation air normally traveling through a building. As the ventilation air passes by a moist surface, it can collect moisture, which it can then carry to a moisture detection and alarm system that resides downstream in the air flow. Thus, even small, localized moisture sources can be detected without the alarm system having to be in direct contact with the leak or the resulting liquid water. In principal, this allows the system to be sensitive to moisture sources anywhere within a particular ventilation zone by sampling the ventilation air stream at a point of confluence, such as just before it exits the affected zone.

This invention should also be clearly differentiated from the many simple humidity monitoring systems that are presently available on a commercial basis. With the presently available systems, the humidity sensors (or their associated alarms) are configured to trigger an alarm once a particular threshold is reached in the area adjacent to the sensor. These simple systems do not modify their alarm behavior as a result of measured environmental changes such as increases in the outdoor humidity levels nor do they self modify to account for the variations in the humidity often resulting from short term occupancy related humidity changes (for example, those produced by the occupants when they shower or do laundry). These presently-available alarms do not provide as accurate and as reliable early warning system which can alert personnel prior to a moisture problem actually developing.

As a consequence of the simple mode of operation, the simple systems typically have their alarm thresholds set to relatively high levels to reduce the number of false alarms and resulting inconvenience to the occupants and building operators. Alternatively, if the alarm thresholds are left low, and many nuisance alarms are produced, the occupants and building operators become conditioned to either ignore the resulting alarms or respond slowly.

These consequences are inherently at odds with the need for early detection of moisture control problems. Desensitizing the alarms to prevent false triggering simultaneously desensitizes the alarms to real problems. In many situations, to accommodate environmental variations and occupant behavior, the alarm thresholds in these systems are set high enough that humidity can exist at levels sufficient to result in building damage, without an associated alarm being triggered.

Alternately, if the systems produce frequent nuisance alarms, the occupants and operators loose trust in the system and fail to respond to alarms accordingly. In contrast, the present invention provides an intelligent, self correcting control mechanism and process wherein the useful sensitivity of the alarm system can remain high so as to detect legitimate moisture control problems early while the frequency of false alarms is dramatically reduced.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
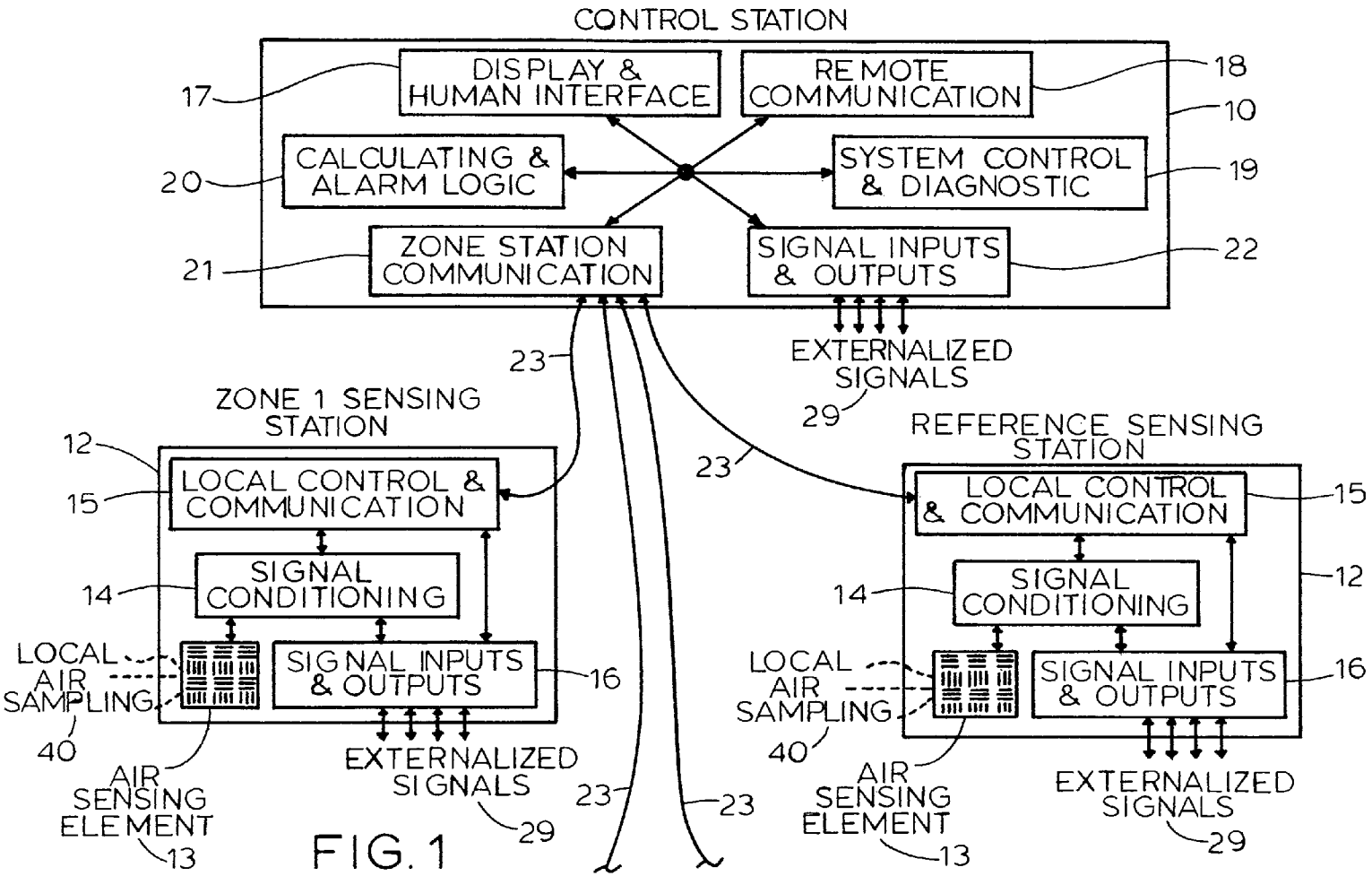
FIG. 1 shows one embodiment of the invention wherein system includes a Control Station, a Reference Sensing Station, and multiple Zone Sensing Stations.

Airborne humidity monitoring provides a direct measurement of the moisture content of the air, effectively the moisture mass that is available to the building environment. In most cases, this measurement will be very responsive to changes caused by a significant moisture source within or adjacent to the building's conditioned envelope.

This invention is based on the psychrometric principles governing the behavior of moisture in air and other materials. Abnormal or undesirable humidity behavior may indicate that a moisture management problem exists. Problems could relate to water leakage, changes in ventilation, dehumidification or air conditioning system performance, building operation or occupancy issues.

The invention described herein utilizes a combination of humidity and temperature monitoring points to assess the prevailing moisture conditions and trends in various conditioned building spaces and zones. Humidity may be optionally measured through absolute or relative means and the measurements may be performed using various methods know within the art based on the psychrometric properties of water in air and building materials. Broadly stated, the invention is embodied in a method wherein the moisture contents within various air volumes around and within a building environmental envelope are monitored and alarms are generated when site configurable combinations of moisture conditions and moisture trends are inconsistent with proper building operation and performance.

Measurements that are able to determine or act as acceptable surrogates for the moisture content in the air and that are applicable over various time scales, may optionally include but are not limited to:

(1) relative humidity or relative humidity corrected to a standard set of conditions to ease comparison;

(2) dew point analysis;

(3) wood moisture content; or (4) determining the absolute moisture content of the air through gravimetric, calorimetric, thermal conductivity or other means.

This disclosure of the invention makes frequent reference to airborne moisture, humidity or relative humidity, however no limitation of the invention based upon the particular terminology and all forms of airborne moisture are implied. The moisture content in the air may be determined using various sensors and detectors based on conductivity, capacitance, chemical reaction, moisture induced dimensional changes, gravimetric, volumetric, thermally induced spontaneous condensation or other means or through other techniques that are or may become known in the art for determining moisture content of air and materials. It is also noted that the invention will be described in relation to a building and to air entering, leaving or residing in the building; however, this description will be for the sake of convenience and is not intended as a limitation since the early warning aspects of the present invention can be applied to any structure, including, but not limited to, storage facilities, clean rooms, equipment rooms and facilities, power plants, and the like, and any air or other atmospheric gas associated with that structure. Furthermore, the term "wood moisture" is a term well known in the art and thus it will not be discussed in detail. Wood moisture varies relatively slowly over long periods as compared to air and is not as responsive an indicator of a recent exposure to moisture. However, wood is inherently an integrator of the general exposure to environmental moisture and can be used to provide a surrogate measure of the long term humidity levels in a building zone. Within our current invention, the wood moisture is seen as an auxiliary measurement that can be used to confirm or contradict an alarm assessment and provide additional diagnostic information on how the building and alarm system is behaving.

Regular and repeatable air moisture measurements are combined through an algorithm to allow the device to assess if the moisture conditions are within normal and acceptable ranges or alternately might be elevated or rising at an unexpected rate. Certain elevated levels or unexpected rates of rise are indicative of water escape, accidental introduction of high moisture content ventilation air or some other moisture management or moisture control failure as previously discussed. The measurements and subsequent processing effectively analyze the humidity within building environments to assess the potential of a moisture management problem that needs attention.

The decision algorithms are at their core a series of staged go/no-go or pass-fail tests that are applied to the results of the various smoothing calculations. Each of the tracked parameters is compared to a series of thresholds, or pre-set values, or to either one or a mathematical combination of other parameters, or in some cases both thresholds and combinations of other parameters to determine if an alarm condition exists.

For example, a simple test could be written as:

IF {parameter_value$_x$>threshold$_x$} THEN activate alarm$_x$;

A practical example of this simple alarm could be:

IF {Standardized_Reference_Humidity>60%} THEN Go_Humidity_Alarm;

A more complicated example might be:

IF {(parameter_value$_x$−parameter value$_y$)>threshold$_{x,y}$} THEN activate alarm$_{x,y}$;

A practical example of this more complicated alarm could be:

IF {(Standardized Station 1 RH−Standardized Reference Station RH)>5%} THEN Go_High_Difference_Alarm;

The overall decision algorithm is a series of such logical tests that are reevaluated on each scan cycle and which might generate zero, one or many alarm conditions.

For many situations of interest, there are three primary conditions that may indicate that a moisture management problem is present. These are, in no particular order:

1) Interior humidity levels exceed values expected based on outdoor, ambient or indoor reference air conditions and normal building use.

2) Indoor humidity levels are increasing at a rate that exceeds the expected change based on outdoor, ambient or indoor reference air conditions and normal building use.

3) Indoor humidity levels exceed a threshold where moisture damage or building deterioration can occur, regardless of the moisture source.

Other important conditions or criteria may also exist for specific building situations.

These primary conditions can be extended to a decision algorithm to implement a series of specific alarms. For example, the instrument may determine an alarm condition based on one or more logic statements, including but not limited to:

(1) The moisture condition within a conditioned zone is higher or inconsistent with the moisture conditions determined from—the reference zone;

(2) The relative humidity within a zone is higher than desired because the makeup ventilation air source is introducing moist air;

(3) The relative humidity within a zone is increasing faster than can be attributed to the rate of increase in the relative humidity within the makeup ventilation air source;

(4) The relative humidity within a zone is increasing faster than a predetermined rate;

(5) The relative humidity within a zone is higher than an allowable limit; or (6) The recent time profile of the relative humidity within a zone is inconsistent with the historical time profile associated with the same space.

The last logic statement (6) assumes that the system has a method or capability to learn and recognize the time dependent behavior of the moisture levels in a building zone and the associated capability to monitor and compare a portion of the recent behavior to the historical profile, in the manner of pattern recognition. As used herein, the term "historical pattern" means that the system is designed to "learn" the moisture behavior patterns over time and then begin to compare the current behavior to historical norms. For example, it the moisture patterns always showed a spike in the morning and evening corresponding to people waking up a bathing or coming home and preparing supper, then these effects could be anticipated and included in the devices definition of what it thought was "normal". Furthermore, as used herein, the term "preset range" means a range that has been independently determined to be appropriate for the particular building and occupancy situation by knowledgeable practitioners based on experience in similar applications and situations and through the use of engineering principals.

The particular threshold or limit values are dependent upon the final installation conditions, as do the time frames on which the alarm decisions are qualified or generated. Typically, individual relative humidity alarm thresholds associated with wood frame buildings would be on the order of 30% to 70%, depending on the exposure period (for instance, higher levels may be allowed for shorter intervals). However, thresholds outside this range may be relevant or desirable in certain situations.

Data smoothing and qualification is incorporated to help suppress short term variations that are expected in occupied, active buildings. Such filtering will also help minimize nuisance alarms induced by local weather and environmental changes that may not be of concern to the building. Typical smoothing time frames are on the order of hours although some applications may require times as short as minutes or as long as days. The method of the present invention includes measuring moisture content at least one selected location and ignoring changes that do not persist for periods longer than a preset time period. As used herein the term "preset time period" is defined as a period that has been independently determined to be appropriate for the particular building and occupancy situation by knowledgeable practitioners based on experience in similar applications and situations and through the use of engineering principals. Essentially, this is value is based on the body of knowledge available to the person who configures the system.

A further capability provided by this invention is the ability to suppress false alarms or otherwise qualify the generation of alarms using multiple moisture measurements and relating them using psychrometric principals. An example of how this helps prevent false alarms would be to consider the following scenario. Consider the case where there is a rise in the relative humidity in the outdoor air as a result of rain. In many cases, the outdoor air is the ultimate source of make up air for the building and the rise in its humidity will eventually propagate to the interior of the building and be reflected as a corresponding increase in indoor relative humidity. Simple humidity alarms with fixed level thresholds may trigger an alarm in this situation, whereas the system and process embodying the present invention can be configured to anticipate the rise in indoor humidity caused by the rise of humidity in the makeup air and in turn adapt the thresholds and rates it uses to determine an alarm condition.

It should be noted that within the context of this discussion, "make up" air may be primarily outdoor air or may be a mixture of air (or gas) from various sources that blend and refresh various building (or structure) spaces. These air sources may be provided intentionally (for example, a conventional make up air intake forming part of the building ventilation system) or may be inherent in the design, construction or condition of the building (for example, air introduced into the structure through infiltration). In any case, the make up air, when properly mixed and conditioned, represents the normal building air conditions. It is noted that the rate of air flow can be determined by any number of means known to the art such as moving vane or hot-wire anemometers, orifice flow meters, ranked sail switches or the like. The actual airflow data could be collected by or communicated into our disclosed system through many interfaces including one of the externalized signal inputs (for example through one of the scanned analog voltage reading inputs or digital inputs) or could alternately be provided to the system through various higher level digital means (such as a readings read through one of the available communication data ports). Once the system has knowledge of the flow rates at the various locations, basic engineering mass flow and material continuity calculations can be performed and used to relate the bulk flow of moisture through the affected building areas.

Of course, as indicated previously in this disclosure and for the purposes of this invention, the concept of relative humidity is only one of several possible and essentially equivalent representations of moisture content in the air. The above example situations could be alternately implemented and related in terms of:

(1) absolute, differential or relative humidity;

(2) absolute or relative water vapor pressure;

(3) equivalent dew point temperature; and/or (4) changes in the moisture content of wood or other building materials including surface or bulk conductivity; or (5) similar concepts, whether they be optionally pressure and/or temperature compensated. These and variations on these are representations known and accepted in the art.

The indicated calculations and decision logic can be based on an analysis of the underlying environmental behavior such as: rates of change in indoor and outdoor conditions; differences between indoor and outdoor moisture and temperature values; comparison with historical levels; and/or possibly through evaluating excursions outside of allowable values.

For instance, wood moisture content monitoring provides a useful mechanism to evaluate the humidity levels and history of the surrounding air to which the wood is exposed. Wood moisture content, especially its gradient with respect to the depth in the wood, gives a view of the longer-term humidity history of exposed wood members since moisture enters and leaves wood given time and a forcing gradient for the moisture (such as differences in vapor pressure). The long-term wood moisture content behavior can thus be used as another factor for assessing and diagnosing building moisture problems. As well and on its own merit, wood moisture is a useful indicator for the potential growth of mold and fungi on the wood and other materials.

More particularly, using various wood moisture measurement techniques, especially those that isolate the wood moisture characteristics at various depths into the affected section of wood, provides information on the moisture exposure history of the affected wood. As a simple example, consider the case where the specific conductivity values of a sample piece of wood are higher near the surface than deeper within the wood section. If this condition exists, then it can be taken that the wood has been exposed to increased moisture levels within a time frame consistent with the moisture permeation response time of the wood. That is, the moisture has not had time to permeate or equilibrate within the wood so as to increase the conductivity of the deeper wood elements.

Temperature monitoring is typically also included in this invention, since it provides both information on the ambient conditions and a reference value against which the humidity or moisture content measurements can be adjusted and interrelated, optionally by adjusting them all to equivalent values at a set of predetermined standard conditions. Localized temperature monitoring also provides for another useful function, that is temperature limit alarms, providing additional building protection through localized detection of high or low temperature conditions and/or possible freeze conditions.

Depending upon the number of sensors and the particulars of the building configuration, various zones or areas of detection can be developed to provide additional space specific information and localization of the diagnostic capability inherent in a such a sensor system.

These features can be incorporated into an automatic, microcomputer or microprocessor controlled instrument that combines real-time measurement and processing with multiple sensors and sensor locations to produce a system capable of effectively monitoring a building without frequent false alarms or through the intervention of an operator except in the case a response to a legitimate moisture problems.

As well as moisture monitoring, the devices can also be provided with the capability to monitor other externalized signal inputs and react to the alarm conditions or externalized signal inputs by activating control functions or outputs. Such features are useful to monitor contact closures of remote switches (such as water detectors or sail switches), analog input signals indicative of building activity and conditions and to provide control outputs to activate other equipment or pass messages to other systems. Devices embodying the present invention can include a number of general purpose digital and analogue inputs and outputs. In the figures, these are noted as "Externalized Signals (29)". These can be used to allow other external signals to be monitored or as control outputs. For instance, a digital input could be connected to a water level switch in a sump pit to detect rising water levels so that the system could generate an alarm. A digital output could be used to activate some piece of external equipment such as a ventilation fan or sump pump. The analogue inputs are similarly useful for monitoring other external sensors that might be present in some situations, such as flow meters, tank level gauges and the like.

A further capability that can be incorporated into the system and process resulting from this invention is the ability to estimate the magnitude of the moisture problem. Since the system has knowledge of the moisture content and temperature of the air and since the system can be provided with information regarding the relative or absolute ventilation rates in the areas associated with each Sensing Station, the absolute evolution rate of moisture into the ventilation air in the zone associated with each Sensing Station can be determined through calculations know to the art. The information related to the ventilation rate may be based on:

(1) an a priori knowledge of the building design and characteristics;

(2) periodic site measurements entered into a database that is available to the computational elements of the invention; or (3) may be measured by the system in a dynamic fashion, possibly through various sensors attached to the system via the Externalized Signal options discussed previously.

There are a number of specific applications that highlight the utility of this invention.

(1) Monitoring Low Traffic Building Areas:

(2) Crawl space and basement areas have been identified as building components that are prone to water leakage and other moisture management problems. Left unattended or not quickly addressed, these elevated moisture conditions can result in significant deterioration of the building infrastructure and contents, including the growth of mold and other biological contaminants. (see Figley et. al mentioned above and incorporated herein by reference)

(3) Monitoring Building Areas That Are Not Normally Occupied:

(4) Monitoring spaces other than traditional buildings which are either occupied or not occupied and which are subject to humidity damage and which are exposed to gas or gases other than air.

Similar to smoke detectors which provide an indication of an airborne smoke source somewhere in the area surrounding the sensor, this invention can provide early detection of moisture management problems in an affected zone. Since airborne humidity changes (particularly increases) will result from water leaks, detecting humidity changes provides information on moisture problems that have occurred somewhere along the path that the air or gas impacting on the detector has traveled. This is an advantage over a flood alarm system since airborne humidity migrates into the bulk air mass and is therefore detectable over a wider region. In contrast, a flood sensor must generally come directly in contact with liquid water to actuate the alarm.

Since it is often difficult to predict where a leak may occur and since leakage may not drain past a flood sensor, many leaks may exist that do not activate a flood alarm.

In these situations, the system and process embodying this invention will provide a more timely alarm because of the broad, integrated building or structure volume that can be sensed. The alarm can indicate that a leak or other moisture problem (such as component failure or vandalism) has occurred and will improve response time to address the problem. This will have broad applications to building monitoring, security and to reducing insurance and repair costs.

Monitoring Building Environments:

Long term monitoring of buildings (owned, rental or leased) can provide valuable information on building operation and operating practices to enhance long term maintenance and durability. Feedback can be provided to the building users to indicate if they are causing moisture problems in their course of daily activity.

Monitoring Remote or Unoccupied Buildings or other Structures:

This invention provides a valuable addition to remote and/or unoccupied building asset management systems since it allows a variety of diagnostics to be performed without an operator present. Remote access to the information produced by this invention, whether or not an alarm condition exists, can provide a building operator with valuable information.

Monitoring Buildings or Structures with Difficult or Dangerous Access:

The system and process embodied in this invention can provide a direct benefit to buildings where access to the monitored zones is difficult or dangerous which is the case in many structures. Examples include:

(1) crawlspaces with very low headroom where entry and movement is restricted;

(2) building spaces where dangerous goods, materials or substances may be present, such as chemical storage areas or facilities; or (3) areas that have been restricted or cordoned off due to the possibility of contamination, such as service tunnels where asbestos insulation is present.

In these types of situations, physical inspections are possible but difficult and expensive to conduct in a safe manner. As such, a monitoring system would allow remote detection of problems which can reduce the need for operator exposure.

Referring to the figures, the system and process embodying the present invention will now be discussed in detail.

FIG. 1 shows one embodiment of the invention wherein the system consists of a Control Station 10, a Reference Sensing Station 11, and multiple Zone Sensing Stations 12. Each Sensing Station makes a measurement or a surrogate measurement of the moisture present in the air 40 impinging on its Air Sensing Element 13. In addition or conjunction with measuring the humidity or moisture content of the surrounding air, the Air Sensing Element may optionally include one or more of:

(1) a temperature sensor;

(2) a temperature compensation element;

(3) a barometric pressure sensor; or (4) other mechanisms known in the art which allow measured moisture values to be compensated or alternately converted to equivalent values at a set of standard conditions.

The Sensing Stations also contain:

(1) a Signal Conditioning element 14 to interface with the Air Sensing Element and at various possible sub-sensors;

(2) a Local Control & Communication element 15 to allow for the acquisition and communication of measurements, convey system data and respond to or generate commands; and (3) Signal Input & Output provisions 16 for acting on or reacting to Externalized Signals.

These capabilities and features can be implemented in a number of fashions such as electronic circuits or other means known to the art.

The Control Station contains:

(1) a simple Human Interface & Display element 17 to allow operator interaction with the system;

(2) a Remote Communication element 18 to allow the system to interact with other equipment and systems, possibly at a large distance;

(3) an element responsible for System Control & Diagnostics 19 to enable selfchecking and monitoring for proper system operation;

(4) a processing element 20 which implements the Calculating & Alarm Logic functions;

(5) a Zone Station Communication element 21 to exchange data and commands with the various Sensing Stations; and (6) provisions 22 for acting on or reacting to Externalized Signals.

These capabilities and features can be implemented in a number of fashions such as electronic circuits or other means known to the art.

The Reference Sensing Station 11 is functionally and performance wise equivalent to a Zone Sensing Station 12, the difference in naming arises from the physical location of the Sensing Station and the significance given to the data it produces. In the case of the Reference Sensing Station 11, the station is located in a position wherein the values it produces are indicative of the ventilation air present at that location and that may be used to flush the other conditioned zone volumes, the purpose being to identify the range and variations in the normal conditions in the building so as to help suppress false alarms. Thus, the measurements from the Zone Sensing Stations 12 can be compared to the Reference Sensing Station 11 to determine if additional moisture is being introduced subsequent to the reference zone.

Although each of the Sensing Stations 11 or 12 are shown as being individually connected via connections 23 to the Control Station 10, there are many other methods of intercommunication schemes known to the art, including but not limited to: peer-to-peer, master-slave, bussed or daisy chain connections, networks and data loops amongst others. No limitation on this invention is implied by the communication connections presented herein. The resulting moisture measurements, possibly including corresponding values of other parameters needed to relate the moisture measurements between stations, are conveyed to the Control Station 10 within which a decision algorithm resides to relate the moisture measurements to other moisture measurement values obtained by the Control Station 10 from other Sensing Stations 11 or 12. Optionally or alternately, the Control Station may assesses the individual moisture measurements against one or more thresholds known to the Control Station 10. The various circuits in the control and sensing stations will smooth the temporal characteristics of the measured values over one or more time frames to reduce the effects of measurement noise and/or short term moisture transients as discussed herein. Furthermore, the circuitry in any or all of the stations can include further circuitry which determines the relative rates of change in moisture content by converting each moisture content to an equivalent value of relative humidity that would be present in the affected air samples if they were at a predetermined set of standard temperature and pressure conditions, and/or which assesses the differential moisture content between smoothed sensed values of moisture content from the selected location and reference location where the time frames over which the two sensed values are smoothed may be different, and/or which measures moisture content for a second pre-set time period and ignores transient changes in moisture content that do not persist longer than that second pre-set time period.

Based upon a rule set and/or a series of defined relationships between moisture measurements or the history of the joint and several moisture measurements (in its entirety, defined as the decision algorithm), the system generates an alarm as required. The system may also optionally collect other information from the Sensing Stations, possibly from the Externalized Signals 29 which may feed into the decision algorithm. As well, either the Sensing Stations or the Control Station may actuate or act on an alarm or non-alarm condition via the Externalized Signal features optionally provided with each station.

Figure 2:
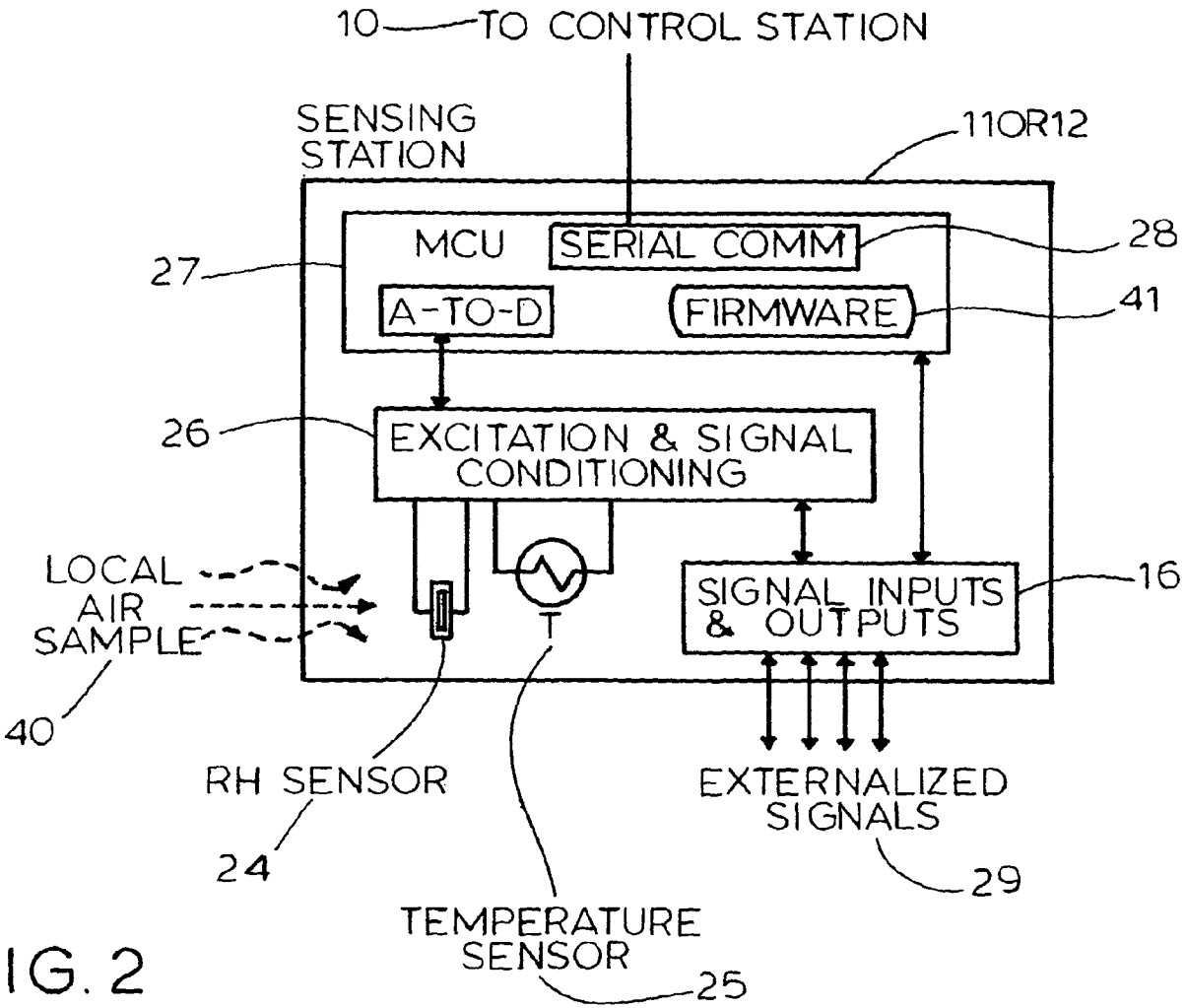
FIG. 2 shows one aspect of the invention wherein the local Relative Humidity and Temperature are measured by the Zone Sensing Stations and conveyed to the Control Station for comparison to measurements retrieved from a Reference Sensing Station.

FIG. 2 shows one configuration of a Sensing Station 11 or 12 wherein the subject moisture measurement is determined from a Relative Humidity sensor 24 in combination with a Temperature sensor 25. The Signal Conditioning element 26 in this case is a relatively conventional excitation and amplifier system feeding into an analog to digital converter controlled by firmware 41 in a microcontroller (MCU) 27. The MCU 27 provides the rapid local scanning capability and can be configured to produce results scaled in engineering units if desired. The MCU 27 also provides the Local Control & Communication functions 15 (FIG. 1), with the communication being accomplished over a serial connection 28. The Externalized Signal functions 29 includes analog and digital inputs as well as digital outputs so that limited process monitoring and control functionality can be accommodated at or near the Sensing Station.

Externalized Signals 29 may include such common functions as contact position detection (for example, to sense a sail switch in a ventilation ductwork system), to activate supporting equipment (for example, to turn on an additional fan or pump) or to measure an analog input (for example, to sense an analog level gauge).

Figure 3:
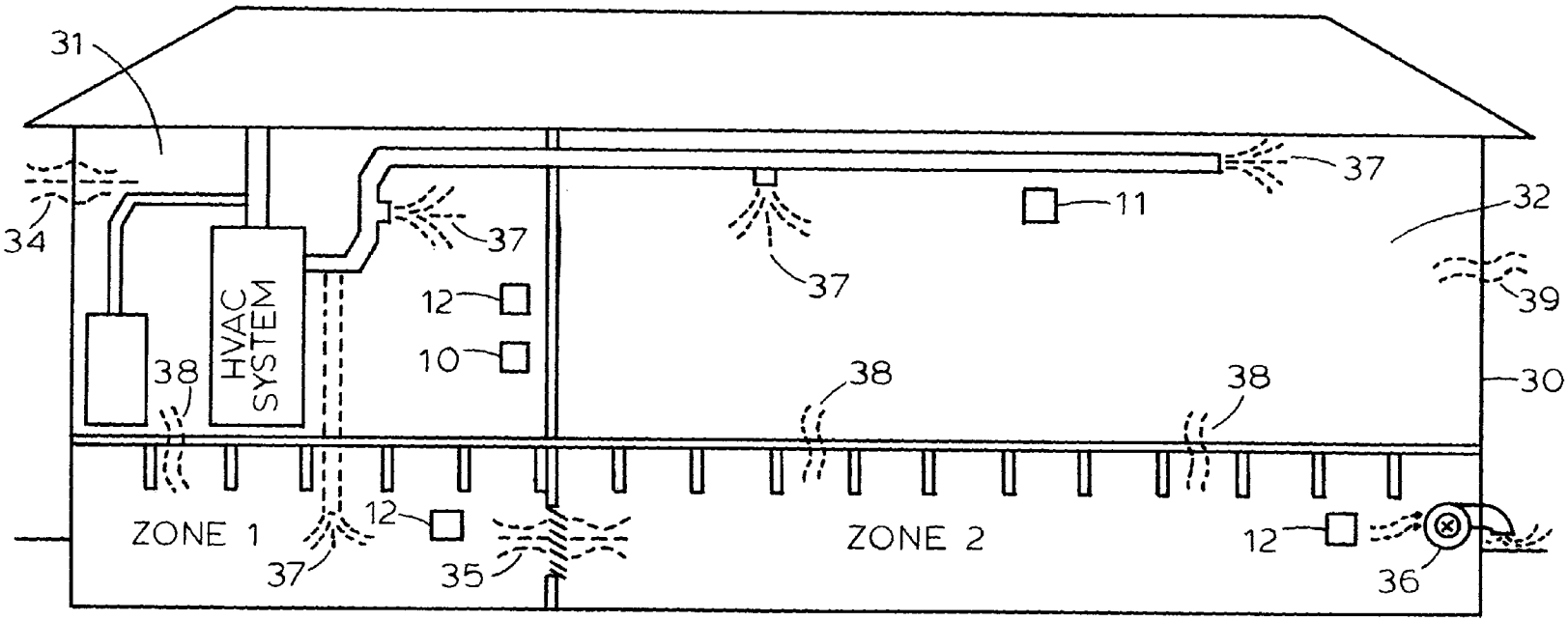
FIG. 3 shows a conceptual diagram of a simple one storey building with a conditioned crawlspace and one embodiment of the system envisioned deployed within the structure.

FIG. 3 shows a conceptual block diagram of a simple one story building 30 with a mechanical room 31, a single occupied zone 32 and a conditioned crawlspace 33 that has been divided into two zones. One possible embodiment of the invention is deployed within the structure.

Note that the Reference Sensing Station 11 is within the occupied building space. The reference moisture values thus obtained inherently contain moisture variations that result from both occupant behavior and from the make up air introduced as part of the conditioned air. Note also that the overall crawlspace ventilation flow is possibly and optionally a combination of both intentional ventilation and unintentional air leakage from conditioned or other building areas.

It is also noted that in the configuration shown in FIG. 3, the Zone Sensing Stations 12 within the crawlspace component of the structure are located within the confluence of the air stream passing between zones 35 or adjacent to the crawlspace depressurization fan 36. In this fashion, each of the Zone Sensing Stations is exposed to the moisture collected by the air as it passes through the crawlspace such that the Zone Sensing Station 12 can detect moisture in the zone without having to be in the immediate vicinity of or in intimate contact with the source of the moisture.

It should also be understood that the indicated crawlspace may also include basements, service ways, chases, tunnels and other such building elements that form part of the building structure or envelope and through which conditioned ventilation air is passed or conveyed.

As well, the application and embodiments associated with this invention can be extended to multi level or multiple story structures. In such buildings, there are service areas or levels positioned amongst or between occupied areas. These service volumes can be effectively monitored for moisture management problems. For example, in many hospitals, there are levels strategically placed between occupied floors wherein various services and infrastructure systems are located. These levels are confined, difficult to inspect and often full of equipment and systems that can leak water. This invention is well suited to monitoring these areas.

Figure 4:
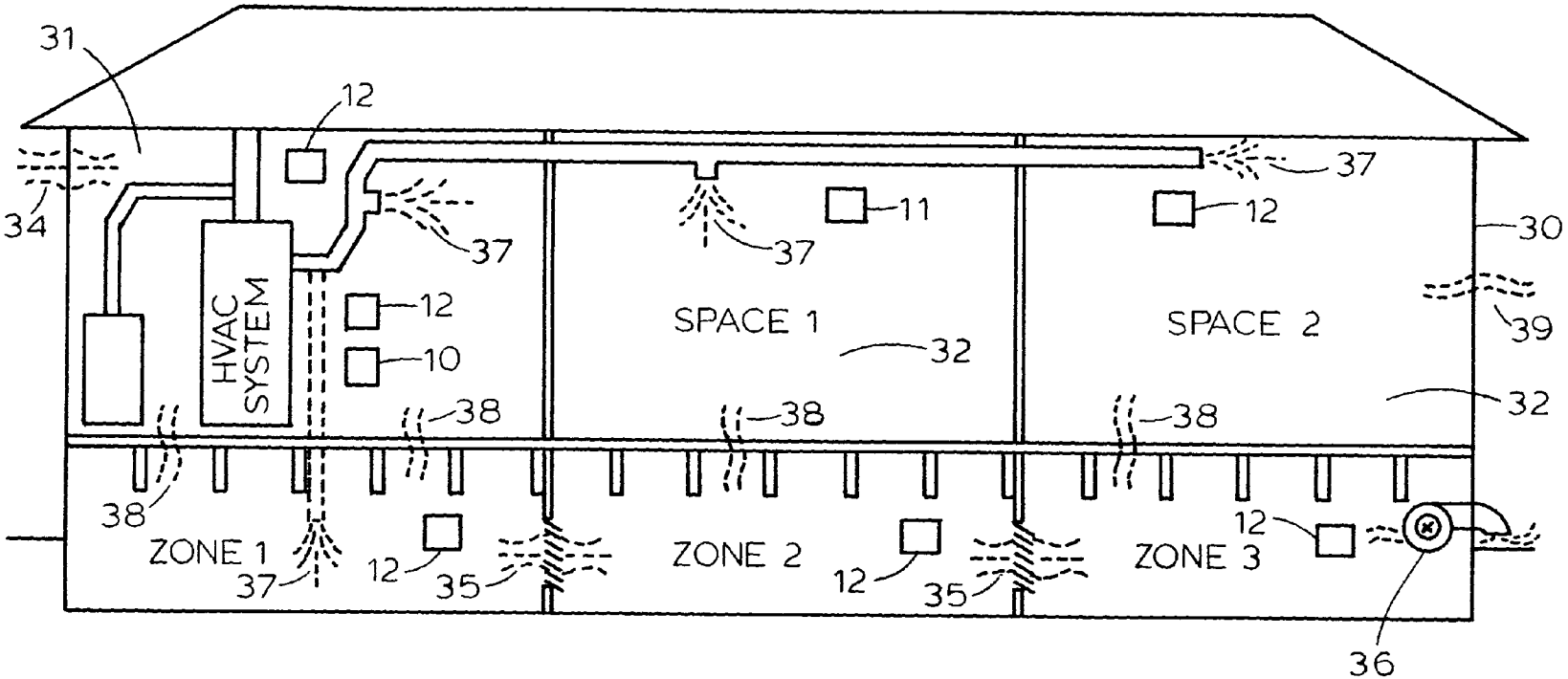
FIG. 4 shows a conceptual diagram of a more complex one storey building with multiple occupied areas and crawlspace zones with another embodiment of the system envisioned deployed within the structure.

A more complex single floor building layout is shown in FIG. 4. In this situation, the crawlspace is divided into several zones and there are two occupied areas of the building. Normally, air can enter each of the crawlspace zones either from the intended ventilation source 37 (including the possibly of air coming from an upstream zone) or from various unintentional sources such as leakage from other building zones 38 (induced by the pressure gradient from the crawlspace depressurization fan), from building infiltration from the exterior environment 39 or by combinations of the above.

The progression in complexity indicated going from the case in FIG. 3 to that in FIG. 4 can be further extended to more complex building structures and situations without departing from the scope of this disclosure or the claims appended hereto.

The ventilation methods and air flow configuration can be complicated, especially so in larger buildings. In some installation and use cases, it might be necessary to configure a system under this invention with multiple Reference Zone Stations 11 to accommodate multiple sources of makeup 34 or ventilation air, various ventilation isolated occupied areas or to accommodate other oddities of building mechanical and HVAC systems. It is often also the case that the make up air to any particular sensing zone can be directly supplied by a ventilation system or can include air that moves intentionally or unintentionally through a building because of design, building operation, environmental conditions or other prevailing conditions known to affect air flow in buildings. However, these scenarios are in principal extensions of the present invention and this disclosure should be taken as to include the possibility of addressing these needs using an appropriately configured system.

By way of illustration of how this system would help diagnose and isolate a moisture management issue within the building shown in FIG. 4, consider the following scenarios.

1. If a significant water leak were present in crawlspace Zone #2 (perhaps resulting from a sewer or water line leak on the crawlspace side of the floor), then this would be detected as an unattributable humidity rise on the Zone #2 and #3 Stations, but not likely on any other Station. Depending on the severity and character of the leak, the problem might be detected based upon the local time rate of change of the humidity, the relative humidity at the Zone #2 or #3 stations exceeding a threshold value, or the standardized humidity at the Zone #2 or #3 stations differing from the expected humidity based on the Reference Zone.

2. If a water leak occurs in the mechanical room located above Zone #1, the water will typically penetrate the floor and run into Zone #1. In this case, the humidity in the mechanical room may or not rise significantly, depending on how much water surface is exposed to the air before the water migrates down through the floor. However, Zone #1 will capture the water penetrating from above which in turn will cause the Zone #1 Sensing Station to activate. The air movement from Zone #1 will increase the humidity in Zones #2 and #3, though often to a lesser extent, and the differences in the humidity measured at the various points will provide diagnostic information on the location of the moisture source.

3. If the outdoor humidity rises as a result of local weather conditions, all the Sensing Stations including both the Reference and Zone positions, should detect a corresponding rise in humidity. Under normal conditions, this would not generate an alarm unless the overall humidity remained high for an excessive period, at which time an alarm may be generated to advise the building operator to attempt dehumidifying the air entering the structure.

4. If the Zone Sensing Station in one of the occupied areas detects a high humidity condition (for example, exceeding a preset value determined in advance for the building and based on building specific criteria), the system will assess for a period and if the condition remains the same or worse, an alarm will be generated. However, in this scenario, the humidity may be the result of a legitimate problem or may be the result of occupancy. In either case the building operator should inspect the Zone and fix the problem or advise the occupant to modify their practices, as appropriate.

5. If the excess moisture is being introduced through an extended surface, such as a wet foundation wall or as moisture wicking up through the crawlspace floor as the result of high soil moisture content, then water may not be present in the crawlspace as a freely flowing or pooling liquid. In this case, a casual visual inspection of the crawlspace would not necessarily identify a moisture problem while traditional flood and leak detectors (such as sump alarms and floor wetting detectors) might not activate. However, the humidity will still increase as water present on the wetted surface is evaporated, and the device resulting from this invention will detect the problem or condition and warn the building operator.

A simplified measurement scan cycle and alarm decision algorithm sequence follows. In this simplified version, the sequence has been foreshortened to improve clarity. It should be understood that multiple sensors are involved and that other operational diagnostics will be occurring in tandem with the sequence described below.

The system will repeatedly scan the various Sensing Stations and calculate both the most recent versions of each Station's values as well as updating its knowledge of the recent history of and trends in the readings. The basic process is as follows:

Scan the measurement stations at a regular rate and update the smoothed version(s) of each of the returned measurement values. There may be more than one integration time constant associated with each parameter, for instance a short and long period version of each measurement value streams. It is noted that the integration time constant is directly related to the length of time that the average is determined over or "smoothed". For the purposes of this invention, the act of integrating the instantaneous readings produces functionally the same effects as averaging and/or filtering the signal, so the terms are used somewhat interchangeably in the text. A longer integrating time constant roughly equates to including more readings into the average or alternately filtering the signal through a lower cutoff frequency low pass filter.

Smoothing a signal using a running geometric average is configured based on the underlying measurement update rate (or sampling rate) combined with the desired number of successive data samples which are to be included in the averages. For example, an average over two samples will have a shorter time constant than an average extending over several hundred samples. Conversely, slowing the sampling rate would increase the time constant since it would take longer to collect the next sample and thus would draw the averaging interval out. In practice, for simple systems, the sample rate is a predetermined or preselected value based upon various hardware and software design issues. However, the number of samples to include in an average is relatively flexible, and this is the mechanism utilized in this embodiment to adjust the relative duration of the integrating time constant. Longer time constants are useful for determining the overall behavior of the air mass, while shorter time constants can be used to monitor short term effects and improve response times. The best of both worlds is achieved when a combination of time constants are utilized which allows both short term excursions to be identified and to monitor long term trends.

The further step of adjusting the smoothed versions of each reading to standard conditions consists of using the noted psychrometric formulae to correct the various representations of each signal (the values smoothed over different time frames) to the equivalent relative humidity readings that would be obtained if all the measurements were taken at a set of standard temperature and air pressure conditions. This allows any inter comparison of the various moisture levels to be made on a common footing. Note that this treatment yields effectively the same results, as far as detecting moisture errors and alarm conditions, as would be obtained if absolute moisture calculations were performed, since the relative and absolute humidity are uniquely linked by the psychrometric behavior of water in air. This approach also allows making equivalent assessments with respect to the moisture mass balance and continuity through the building, for the same reasons noted in this disclosure.

Test the smoothed versions of each of the individual readings against various alarm threshold limits and alarm if appropriate. Note that alarms may be generated based on the amplitude of the smoothed values (including optionally one or more of absolute, relative and differential representations) or the time rate of change of the smoothed values (again including optionally one or more of absolute, relative and differential representations). Note also, that based upon the measurements being gathered from the Reference Station, the alarm function associated with individual reading excursions outside the corresponding limits may be automatically suppressed for a period to allow for expected transient excursions without generating an alarm.

Adjust the smoothed versions of each of the readings to standard conditions. Based upon the differences between each Zone Station and the Reference Station, generate alarms based optionally on either or both the smoothed differences and the smoothed rates of change.

Note that the time rate of change alarm functions and underlying calculations can be approximated and/or alternately implemented in a number of ways. One typical method would consist of keeping a sufficiently deep record of the history of a particular signal or signal calculation and computing the derivative by numerical means known to the art. However, this approach can be memory and computationally intensive given the calculating capacity of the low power electronics normally associated with monitoring systems. An effective alternative that does not require maintaining a detailed history of a signal or signal calculation is to assess the difference between the signal when it is filtered or averaged over both long and short time frames. Although not mathematically identical to calculating a derivative, this accommodation yields almost equivalent behavior with respect to the resulting alarm action. It is noted that the just-mentioned time frames are not fixed. An experienced person will identify appropriate long and short time frames based on their knowledge of how the building should behave. In typical buildings though, short could be a time frame of one to a few hours and long could be 8 to 16 hours, but these are just starter values. "Short" could be shorter or longer as could "long". However, there would typically be a significant ratio between the short and the long periods, at least a factor of two or three, more likely a factor of 6 or 10.

By way of illustration, consider a single time varying input signal. For slow variations in the input signal, both the long and short time frame averages will have approximately the same value, since there is little difference between successive measurements. However, when the signal begins to vary on a time frame shorter than the response time of the longer period filter, the shorter period filter will converge while the longer filter response lags. The magnitude and duration of the difference between the long and short period filters is therefore representative of the time rate of change in the input signal, and in many cases may be used effectively as a surrogate. However, this invention does not necessarily prefer one method of assessing the time rate of change of a signal over another and no limitation in the invention should be taken based upon the manner that the time rate of change of a signal is assessed.

As used herein, the term "smoothed" is a generic term used to indicate that a value being used in a calculation is not an instantaneous reading determined from an input. Smoothing generally uses some fashion of integration to remove high frequency content in a signal to help suppress noise and fast transient errors in the underlying data stream. In analogue circuits smoothing can be done using analogue low pass filters that tend to smooth out the incoming signal. In digital circuits smoothing generally takes the form of some type of numerical running average, such as a "moving window" or similar technique. Many of these digital smoothing techniques require maintaining a record or history of the recent measurement values so that calculations can be repeated as each new reading is obtained. In the case of the moving window average, the calculation marches forward in time with older values falling out the far end of the window as new values enter at the front. This technique requires providing some sort of data queue where the newest data enters into the queue at one end and ripples the data down through the queue as each new entry is stuffed and eventually flushed the oldest data out the far end of the queue. Such queue's require a lot more memory depth (hence the reference to "deep") to store all the data that will be included in each calculation cycle, which places a requirement on the system to have more memory available. This is especially cumbersome if the depth of the queue must be changed on-the-fly to accommodate changing integration times or smoothing intervals.

It is also noted that a practical alternative to the moving window style of averaging that is used in memory limited embedded processing applications, is to use a running geometric average, sometimes also referred to as a "leaky integrator". This leaky integrator gives the most recent sample some proportional weight factor in the average and adds it to a fraction of the old average. The fraction of the old average and the proportional weight factor are designed to add to a numerical value of "one".

The geometric averaging function typically looks something like:

$$\text{New_Average} = \frac{\{\text{Old_Average} \times (\text{Integration_Interval} - 1) + \text{New_Value}\}}{\text{Integration_Interval}}$$

where the New_Average is the updated average, the Old_Average is the average from the last scan cycle and the Integration Interval is the number of samples in the average.

This function provides many of the same desirous integration or low pass filtering properties that are available with the moving window style averages, but requires far less memory to implement since all that is needed to calculate the latest average is the previous average value and the most recent data point.

The physical location of the processing functions and elements assumed in the foregoing discussion is, for convenience, taken as being resident in the Control Station. However, as is known in the art, processing functions and elements or parts thereof can reside in multiple, diverse and possibly redundant locations within a data acquisition and analysis system. This disclosure should not be read as being limited in these respects as many other computational layouts are compatible with and considered by this invention.

The foregoing discussion also makes reference to transforming the moisture levels measured at a Station to an equivalent value at a standard set of conditions. As an example of the calculations required to perform this conversion, consider a system wherein the moisture is assessed using Relative Humidity (RH) measurement concepts.

The RH values may be transformed between various temperatures, particularly from Station conditions to standard conditions through an intermediate evaluation of the absolute vapor pressure of water at each station which is then used to calculate what the equivalent RH would be under standard conditions. In this example, the calculations follow the pattern below.

The conversion starts with a calculation of the amount of water vapor, e, present in the air, as a fraction of the total water vapor, $e_s$, that would be in the air if it were saturated with moisture at the same temperature and pressure. The relative humidity can be expressed as:

$$RH = e/e_s \tag{1}$$

Note that for discussion purposes in this simplified version of the RH analysis, it is assumed that the prevailing conditions at a Sensing Station will be restricted to a measured temperature range of 0° C. to 50° C. and to a measured relative humidity range of 5% to 95%. If measurement values are obtained that fall outside of these extremes, the RH analysis may be done using clamped values to constrain the behavior of the subsequent mathematical operations. This accommodation is made to restrict the complexity of the mathematical operations in the currently preferred device to remain within regions of the psychrometric behavior of water and water vapor in air that are well behaved. However, it should be understood that a more elaborate version of this discussion would include an extended version of the following formulations and computations that can provide conversions across all relevant operating conditions. This invention could be used and this invention should be read as to include the more elaborate version of the computations. At a temperature T (in ° C.), the saturation vapor pressures (T), in pascals (Pa), over liquid water, is calculated using the Magnus formula (slightly rearranged):

$$e_s \cdot T^\circ \text{ C.} \cdot = e^{ln \cdot 611.2 \cdot \cdot \{17.62\ T/(\cdot 243.12 \cdot T \cdot\}} \cdot \quad (2)$$

For the specified range of temperatures, the values given by equation (2) are quoted as having an uncertainty of less than ±0.6 percent of value, at the 95% confidence level. The just-presented formula is disclosed in the above-referenced provisional patent application, the disclosure of which is incorporated herein by reference.

A more accurate but correspondingly more complex alternative formula for saturation vapor pressure (in Pa) at a given dew point temperature is (Note that T is now expressed in Kelvin) is:

$$e_s \cdot T^\circ \text{ K.} \bullet = e^{\cdot\cdot 6096.9385 T \cdot 1 \cdot 21.2409642 \cdot 2.711193 \times 10 \cdot 5 T2 \cdot 2.433502\ ln\ T \cdot\cdot} \quad (3)$$

(Formulae due to Sonntag, 1990, updated from formulae given by Wexler, 1976 and 1977 and presented in the above-referenced provisional application the disclosure of which is fully incorporated hereinto by reference.)

The uncertainties associated with equation 3 are quoted as being less than 0.01 percent of value at the 95% confidence level.

The accuracy of these calculations depends slightly on the pressure and temperature of the gas concerned. For air near room temperature and atmospheric pressure, the water vapor enhancement factor, affects the result by approximately 0.5 percent of value.

In the preferred embodiments discussed herein, the above equations can be used to relate the humidity measured under various atmospheric conditions. However, these are just one example of how the conversion and comparison can be accomplished using the RH as the starting point. For Air Sensing Elements using different detection principals, other conversion mechanisms may be more appropriate. No limitation of this invention should be taken or implied through the presentation of this example, as other calculations and methodologies are known in the art to interrelate RH and other airborne moisture representations.

The method embodying the present invention thus includes the following steps and sequences:

Note that the following measurement process and the associated calculation sequences are an illustrative case and relate to the currently preferred embodiments as they are described herein. Other electronic configurations and data treatments methods are equally anticipated by this invention and can be shown to provide equivalent functionality.

Where reference is made to averaging calculations, it should be noted that there are analogue based electronic processing circuits that can accomplish these same goals, so that a comparable system could be developed using analogue design techniques. Further, within the field of analogue design, the functions of comparing a signal to a threshold or determining the difference between two signals as being within or exceeding a threshold are well known and could be used to implement an analogue version of this preferred embodiment.

No limitation on the disclosed invention should be taken by the use of terms indicating solely digital processing techniques.

(i) The System begins a scan cycle. The Control Station requests the moisture data from each sensing station (refer to FIG. 1 for an example of a physical configuration that allows this activity to occur).

(ii) Moisture data from each Sensing Station, including the Reference Sensing Station, is received by the Control Station. In this preferred embodiment, the data from each Sensing Station consists of the local Temperature and Relative. Humidity expressed in appropriate engineering units. Note that other representations of the moisture content of the air, such as the dew point, for each station's moisture readings could be used to similar effect.

(iii) The Control Station temporarily saves the data from each Sensing Station and calculates the effective Standardized Relative Humidity value that would be present at each Sensing Station, based upon each Sensing Stations recently reported relative humidity and temperature. The recent scan data from each Sensing Station is retained until the next scan cycle. At this point in the sequence, the Control Station has the most recent value of the Temperature, Relative Humidity and Standardized Relative Humidity from each Sensing Station at hand.

(iv) The Control Station updates the running geometric averages for each parameter of interest on an individual Sensing Station by Sensing Station basis. The running averages are determined over short, medium and long term time frames for the Temperature, Relative Humidity and Standardized Relative Humidity.

(v) The Control Station performs a series of conditional magnitude tests on the various running average results. The thresholds or preset values for these tests are configured as a table when the Control Station is commissioned. If any conditional test fails, an appropriate alarm is generated by the system. Individual tests can be effectively enabled or disabled by the choice of alarm threshold limits.

(vi) The Control Station performs a series of conditional magnitude tests on pairs of running averages. For example, the difference between the long and short term averages on a single Sensing Stations Relative Humidity value are assessed to detect a rapid rate of rise in the Relative Humidity at one location. Another example might be the difference between the long term average Relative Humidity at the Reference Sensing Station compared to the short term average Relative Humidity at a particular Sensing Station, to assess whether unexpected moisture was present at a Sensing Station location.

Because there are many possible combinations of pairs of averages (considering the number of Sensing Stations, the multiple averaging intervals and the raw and Standardized versions of the humidity parameters) the particular pairs of averages that are tested are defined when the firmware for the Control Station is created. However the thresholds that are applied during each test are configurable at system commissioning so that the sensitivity of each test can be adjusted. If any conditional test fails, an appropriate alarm is generated by the system. Individual tests can be effectively enabled or disabled by the choice of alarm threshold limits.

(vii) The system has completed one scan cycle and now waits for predetermined period (the scanning interval) before initiating another scan of the Sensing Stations. While waiting for the next measurement scan cycle to occur, the Control Station can perform other diagnostic and analysis functions which may require communicating with the Sensing Stations.

(viii) The system initiates another scan cycle and repeats the above sequence, updating the various averages as appropriate and repeating the indicated tests. This sequence continues indefinitely.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method of monitoring the moisture content of air located in a structure comprising:

A) measuring the moisture content in a sample of air at a reference location and using the moisture content in the sample of air from the reference location as a normal value, the reference location being in a position whereat air flowing into the structure is representative of the total air flowing into the structure;

B) measuring the moisture content in air located at a selected location within a structure and using the moisture content in the air from the selected location as a sensed value;

C) smoothing the temporal characteristics of the measured values over at least one time frame to reduce the effects of measurement noise and short term moisture transients;

D) relating the smoothed sensed value of moisture content from the selected location to the smoothed normal moisture content from the reference location and defining a differential moisture content; and E) generating an alarm if the differential moisture content exceeds a preset value.

2. A method of monitoring the moisture content of air located in a structure comprising:

A) measuring the moisture content in a sample of air at a reference location and using the moisture content in the sample of air from the reference location as a normal value;

B) measuring the moisture content in air located at a selected location within a structure and using the moisture content in the air from the selected location as a sensed value;

C) smoothing the temporal characteristics of the measured values over at least one time frame to reduce the effects of measurement noise and short term moisture transients;

D) relating the smoothed sensed value of moisture content from the selected location to the smoothed normal moisture content from the reference location and defining a differential moisture content, including using information regarding the rate of flow of air entering the building; and E) generating an alarm if the differential moisture content exceeds a preset value.

3. A method of monitoring the moisture content of air located in a structure comprising:

A) measuring the moisture content in a sample of air at a reference location and using the moisture content in the sample of air from the reference location as a normal value;

B) measuring the moisture content in air located at a selected location within a structure and generating a series of graduated pairs of preset values and preset periods;

C) smoothing the temporal characteristics of the measured values over at least one time frame to reduce the effects of measurement noise and short term moisture transients, and using the moisture content in the air from the selected location as a sensed value;

D) relating the smoothed sensed value of moisture content from the selected location to the smoothed normal moisture content from the reference location and defining a differential moisture content;

E) generating an alarm if the differential moisture content exceeds a preset value; and F) measuring the moisture content of the air at the selected location in a series of graduated pairs of preset values and preset periods and using the graduated pairs of preset values and preset periods to evaluate the presence of an alarm condition based on the amplitude of the measured value exceeding a preset value for more than a preset interval.

4. A method of monitoring the moisture content of air located in a structure comprising:

A) measuring the time rate of change in moisture content in a sample of air at a reference location and using the time rate of change of moisture content in the sample of air from the reference location as a normal value;

B) measuring the time rate of change in moisture content in air located at a selected location within a structure and using the time rate of change in moisture content in the air from the selected location as a sensed value;

C) smoothing the temporal characteristics of the time rates of change of the measured values over at least one time frame to reduce the effects of measurement noise and short term moisture transients, the smoothing comprising steps of using long term measurements with short term measurements, with short term measurements being less than one hour in duration and long term measurements being at least twice as long in duration as the duration of the short term measurements and as much as ten times as long as the duration of the short term measurements;

D) relating the smoothed sensed value of time rate of change of moisture content from the selected location to the smoothed normal time rate of change of moisture content from the reference location and defining a differential time rate of change of moisture content; and E) generating an alarm if the differential time rate of change of moisture content exceeds a preset value.

5. A method of monitoring the moisture content of air located in a structure comprising:

A) measuring the moisture content in a sample of air at a reference location and using the moisture content in the sample of air from the reference location as a normal value;

B) measuring the moisture content in air located at a selected location within a structure and using the moisture content in the air from the selected location as a sensed value;

C) smoothing the temporal characteristics of the measured values over at least one time frame to reduce the effects of measurement noise and short term moisture transients;

D) relating the smoothed sensed value of moisture content from the selected location to the smoothed normal moisture content from the reference location and defining a differential moisture content;

E) defining a series of parameter pairs, wherein each pair specifies the value of a differential moisture content alarm threshold and a corresponding preset time period during which excursions of the differential moisture content above the corresponding alarm threshold can be tolerated; and F) defining an alarm condition as being when an excursion of the differential moisture content above a particular differential moisture content alarm threshold has persisted longer than can be tolerated according to the associated alarm preset time period that is paired with the differential moisture content alarm threshold.

6. A method of monitoring the moisture content of air located in a structure comprising:

A) measuring the time rate of change in moisture content in a sample of air at a reference location and using the time rate of change of moisture content in the sample of air from the reference location as a normal value;

B) measuring the time rate of change in moisture content in air located at a selected location within a structure and using the time rate of change in moisture content in the air from the selected location as a sensed value;

C) smoothing the temporal characteristics of the time rates of change of the measured values over at least one time frame to reduce the effects of measurement noise and short term moisture transients, the smoothing comprising steps of using long term measurements and ignoring short term measurements, with short term measurements being more than one hour in duration and long term measurements being at least twice as long in duration as the duration of the short term measurements;

D) relating the smoothed sensed value of time rate of change of moisture content from the selected location to the smoothed normal time rate of change of moisture content from the reference location and defining a differential time rate of change of moisture content; and E) generating an alarm if the differential time rate of change of moisture content exceeds a preset value.

7. A method of monitoring the moisture content of air located in a structure comprising:

A) measuring the time rate of change in moisture content in a sample of air at a reference location and using the time rate of change of moisture content in the sample of air from the reference location as a normal value;

B) measuring the time rate of change in moisture content in air located at a selected location within a structure and using the time rate of change in moisture content in the air from the selected location as a sensed value;

C) smoothing the temporal characteristics of the time rates of change of the measured values over at least one time frame to reduce the effects of measurement noise and short term moisture transients, the smoothing comprising steps of using long term measurements and ignoring short term measurements, with short term measurements being approximately one hour in duration and long term measurements being at least twice as long in duration as the duration of the short term measurements;

D) relating the smoothed sensed value of time rate of change of moisture content from the selected location to the smoothed normal time rate of change of moisture content from the reference location and defining a differential time rate of change of moisture content; and E) generating an alarm if the differential time rate of change of moisture content exceeds a preset value.

* * * * *